US006113507A

United States Patent [19]

Padilla

[11] Patent Number: 6,113,507

[45] Date of Patent: Sep. 5, 2000

[54] QUICK-ATTACH SPORTS NET

[76] Inventor: Ronald G. Padilla, 1070 S. Owens St., Lakewood, Colo. 80226

[21] Appl. No.: 09/253,737

[22] Filed: Feb. 22, 1999

[51] Int. Cl.[7] ..... A63B 67/00

[52] U.S. Cl. ..... 473/478; 273/400

[58] Field of Search ..... 273/398–402, 273/390, 396; 296/37.16, 37.6; 473/197, 478, 454; 410/96, 97

[56] References Cited

U.S. PATENT DOCUMENTS

| | | | |
|---|---|---|---|
| 2,895,737 | 7/1959 | Blees | 473/478 |
| 4,836,542 | 6/1989 | Crawley | 473/197 |
| 5,114,019 | 5/1992 | Sandbank | 211/41 |
| 5,308,083 | 5/1994 | Grunfeld et al. | 273/400 |
| 5,342,063 | 8/1994 | O'Brien | 473/197 |
| 5,716,176 | 2/1998 | Anderson | 410/118 |
| 5,920,929 | 7/1999 | Hensley et al. | 5/81.1 T |

*Primary Examiner*—Mark S. Graham
*Attorney, Agent, or Firm*—C. Corbin

[57] ABSTRACT

A sports net adapted to be quickly attached to and detached from a sports goal frame such as a portable frame for soccer goal or a street hockey goal, the frame having tubular members and including a first U-shaped upright portion for forming a goal mouth with a crossbar and side posts, and a second U-shaped portion connected to the upright frame portion and adapted to lie on a horizontal surface, and oblique portions interconnecting the upright and horizontal frame portions. An elastic cord element is incorporated in the outer perimeter of the generally rectangular net and the cord constricts the perimeter and forms an expandable opening. The net can be draped over the goal frame and properly aligned with the frame with the aid of colored indicia attached to the net, and the perimeter tucked around the frame such that it resiliently embraces the insides of the frame members of the first and second portions so that the net is releasably secured to the frame.

7 Claims, 1 Drawing Sheet

QUICK-ATTACH SPORTS NET

BACKGROUND OF THE INVENTION

1. Field of the Invention

The present invention relates to sports nets for portable soccer goals, street hockey goals, and the like, and more particularly to such a net that can be quickly mounted and detached from a goal frame.

2. Description of the Prior Art

The conventional manner of attaching a ball-retaining net to portable soccer and street hockey goals involves draping a net over the rear of the goal frame and then fastening the perimeter of the net to the frame members using string ties. See U.S. Pat. No. 5,53,733, for example.

In some cases the net perimeter portion is wrapped round adjoining frame member and then fastened to itself using a number of ring clips, safety pins and the like. Of course, at the end of play, to detach the net, the attachment steps are reversed. It is not surprising that such methods and apparatus can make the net attachment and detachment task one that can be awkward, painstaking and relatively time-consuming, and additionally , the various fasteners and clips are often lost or misplaced.

The prior art reveals several efforts at alleviating some of the problem associated with attaching and removing sports nets. The approach disclosed in U.S. Pat. No. 5,476,266 regarding soccer goals is to secure longitudinally extending C-shaped channels to surfaces of the goal frame, and to provide a plurality of hanger elements spaced long the net perimeter, the hangers being insertable in the C-shaped channels so as to removably mount the net.

In U.S. Pat. No. 3,507,494 a number of metal hooks are paced apart along a net perimeter to support the net on frame.

U.S. Pat. No. 5,615,889 shows number of straps extending outwardly from the net perimeter, whereby each strap can the looped around adjoining goal frame members and removably secured to itself using a snap latch.

In U.S. Pat. No. 5,421,586 sleeves of mesh material along the net perimeter receive the tubular posts of a goal. Finally, in U.S. Pat. No. 5,180,167 the net is supported from a frame by a number of spaced-apart rings, similar to the way a shower curtain is attached to a curtain rod. Despite the various advantages that may be brought by some developments in the prior art, they are not without their drawbacks, thus the need remains for improvements.

SUMMARY OF THE INVENTION

In view of the foregoing, it is an general object of the present invention to provide a sports net that can be quickly and easily attached to, and detached from, a goal frame.

A more particular object is to provide a net system that does not require the use of a plurality of individually fastening parts, such a clips, rings, straps, and the like.

A further object is to provide a sports net that does not have to be made in a size that exactly fits a given goal, but one which has a big enough tolerance to properly fit goals of varying sizes.

These and other objects and advantages are provided by the present invention of a sports net adapted for quick attachment to a goal support frame, the frame typically having a front U-shaped upright part that forms the goal mouth, and a rearward part including a U-shaped portion adapted for engaging a floor or the ground. Support structure interconnecting the upright and the rearward parts serve to stabilize the frame and also hold the net rearwardly of the goal mouth for a certain distance when mounted in manner to be described.

The invention features a net that is easily attachable to the afore-described frame by virtue of having elastic means mounted in the outer perimeter portion of the net for constricting the net outer perimeter. In a preferred embodiment the elastic means comprises elastic cord that is engaged through net openings along the net outer periphery. The net can be positioned over the outside of the frame to cover it from the goal mouth rearwardly to the ground-engaging U-shaped member and colored indicia on the net perimeter ensure proper alignment of net with frame. The net is thereby engageable over and around the perimeters of both U-shaped members so that the net outer periphery lies inwardly of the members whereby it elastically embraces the members to hold the deployed net in place.

DETAILED DESCRIPTION OF THE INVENTION

Figure 1:
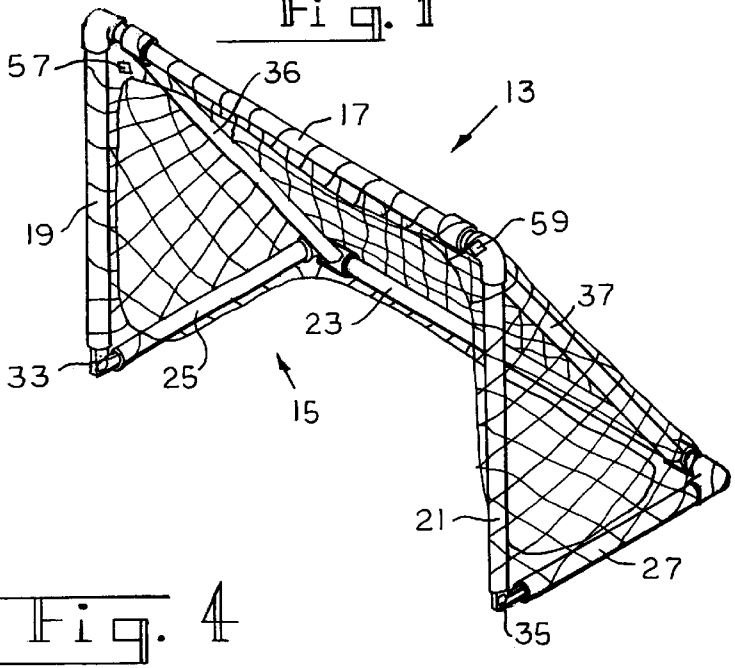
FIG. 1 is a perspective view showing a preferred embodiment of sports net according to the present invention, applied to a goal frame.

Referring now to the drawings, FIG. 1 shows a preferred embodiment of a sports net 13 applied to typical goal frame 15. Frame 15 is seen to have a U-shaped front portion for forming a goal mouth, and includes cross bar 17 and side poles 19 and 21. The frame 15 is preferably has a construction of tubular plastic such as PVC, and incorporates a number of suitable Tee and elbow fittings. Of course the frame can be made of other durable and rigid material such as tubes of metal.

A second U-shaped frame component is adapted to engage the floor or the ground, and has cross bar 23 and side bars 25 and 27, and the free ends of the first U-shaped member connect to those of the second upright U-shaped member by connectors 33 and 35 respectively.

Finally it is seen that pair of oblique bars 36 and 37 interconnect and stabilize the U-shaped components, and also help to hold the net a distance back from the goal mouth, when the net 13 is mounted to the frame in a manner to be described.

Figure 2:
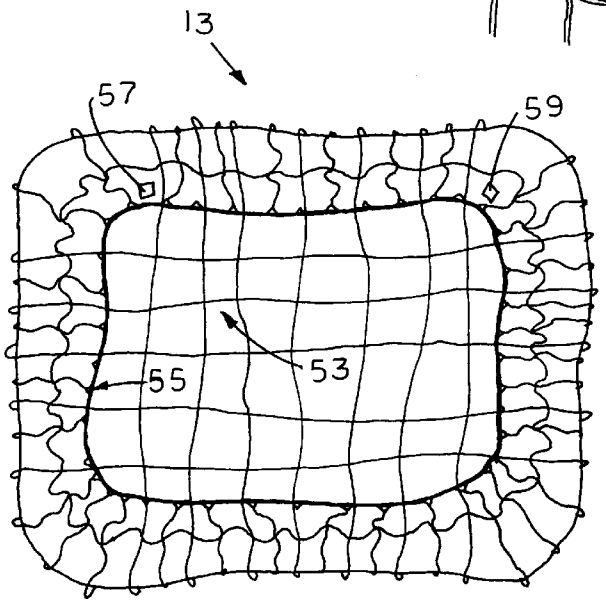
FIG. 2 is top plan view of the net of FIG. 1 in its configuration when removed from the support frame.

In the top plan view of FIG. 2, the sports net 13 is unattached from a frame and resting on a flat surface, and it is shown to have a generally rectangular configuration, with an expanse of conventional netting 53 of material that is flexible and sufficiently strong for the purpose of withstanding impact of a soccer ball or a hockey puck, the mesh of the net being sized according to the particular sport. The outer perimeter of the nettings 53 has an elastic cord element 55 mounted therein, and it is seen to constrict the net perimeter somewhat inwardly, as shown. It should be appreciated how this constricted perimeter defines an opening that can be resiliently expanded to allow mounting of the net 15 in a manner to be described. The cord element 55 is made of suitable rubber, and is covered by thin scrim of woven nylon for wear protection. The tags 57 and 59, which are fabricated of durable plastic material that is brightly colored, will serve as indicia for ensuring that net 13 is oriented in preferred manner with respect to the frame 15 when it is mounted thereto.

Figure 3:
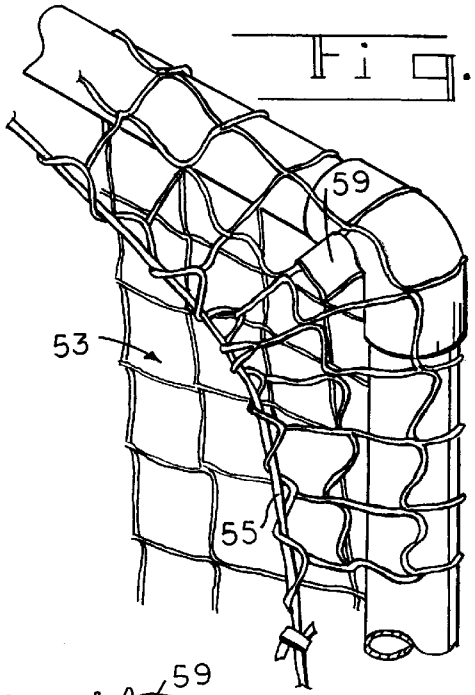
FIG. 3 is an enlarged, partial perspective view of the net of FIG. 1.

The enlarged view of FIG. 3 best show how the cord element 55 is interwoven through the perimeter of netting 53, and how opposite ends of the band of cord are secured to each other by a metal crimp 61.

Figure 4:
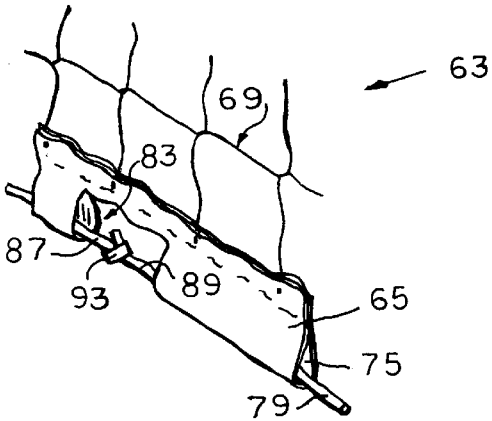
FIG. 4 is an enlarged partial, perspective view of variant of the invention.

FIG. 4 is a partial view of another embodiment of a sports net 63 according to the present invention in which a sleeve member 65 of a suitable flexible yet durable material is secured to the outer perimeter of a sheet of netting, material 69. FIG. 4 also shows how the lower edge portion of net 69 is sandwiched and stitched in place between portions of the sleeve material, and a channel 75 is formed as shown.

A cord 79 of elastic material, like the cord used in the above-described net 15, is mounted within the sleeve 65. At least one opening 83 in the sleeve 65 facilitates initial installation of the cord 79, and opposite ends 87 and 89 of the cord are secured to each other with metal crimp 93.

In order to mount the net 13 to the goal frame 15, a preferred method first calls for draping the net over the frame 15, with the two markers 57 and 59 towards the front of the frame. The desired orientation of the net is ensured by making general alignment of the first marker 57 adjacent to the upper left hand corner of the goal frame, as viewed in FIG. 1, and the other marker 59 adjacent the upper right hand corner of the frame. (It should bee appreciated that other forms of indicia may be used. For example, the edge portion of net 13 corresponding to the front of the goal frame could be spray painted a distinguishing color.) After the front of the net is engaged over the front crossbar as shown in FIG. 1, the opposite part of the net 13 can be tucked under the rearwardmost frame member. Finally, the remaining perimeter of the net 13 can be resiliently stretched and tucked under the lower left and lower right bottom frame members respectively, to complete installation. The reversal of the foregoing process allows the net to be quickly and easily removed from the goal frame.

While particular embodiments of the invention have been shown, it is not intended that the invention be limited thereto. Various modifications and variations of the invention will be evident to persons of ordinary skill in the art, given the benefit of this disclosure. For example, although the preferred embodiment of the invention is designed for portable goals, there are larger sized versions of the invention that can be used on standard sized soccer goals. It is intended that the various modifications and variations be included under the invention which is to be given its full scope and breath as defined in the claims which follow.

What is claimed is:

1. A method for removably attaching a sports net to a sports goal frame, the frame having a construction of rigid frame members and adapted to be self-supporting on a generally horizontal surface, and having a front, top, rear, opposing sides and a bottom, said method including the steps of:

a. providing a net having an expanse large enough to cover the top, rear, and opposing sides of said frame, and having a perimeter portion that extends by a predetermined distance beyond the expanse of said net;

b. providing in said net perimeter a band of elastic material extending along said perimeter portion whereby said net has an elastically constricted opening; and c. draping said net over said frame top, rear and opposing sides and elastically expanding said perimeter portion so that it is positioned over and around said frame members on said frame bottom, front and rear whereby said net is held in place by resiliently embracing said frame.

2. A method as defined in claim 1 including the step of providing on said net perimeter portion means for visually indicating the desired alignment of said net relative to said frame.

3. A sports net for quick attachment and detachment from a sports goal frame, and adapted to be used with said frame, the frame having a construction of rigid frame members and adapted to be self-supporting on a generally horizontal surface, and having a front, top, rear, opposing sides and a bottom, said net including:

a. a mesh of loops of substantially inelastic strands, and having an expanse large enough to cover the top, rear, and opposing sides of said frame, and having a peripherally extending perimeter portion that extends by a predetermined distance beyond the expanse of said net and channel means in said perimeter portion;

b. an elastic cord, joined end-to-end in a loop, and slidably mounted in said perimeter portion channel means whereby said net has an elastically constrictable opening; and c. whereby said net can be draped over and positioned with respect to said frame, and said constrictable opening receiving said frame top, rear and opposing sides, and said perimeter elastically expandable so that said perimeter is positioned over and around said frame members on said frame bottom, front and rear whereby said net is held in place by resiliently embracing said frame.

4. A net as defined in claim 3 including means on a portion of said net perimeter for visually indicating alignment of said net relative to said frame when said net is mounted to said frame.

5. A sports net as defined in claim 3 wherein said channel means comprises said loops in said net perimeter portion, and said cord is interwoven through said perimeter loops.

6. A sports net as defined in claim 3 wherein said channel means comprises a sleeve.

7.A sports net and goal frame combination, said net adapted for quick attachment and detachment from said sports goal frame, the frame having a construction of rigid frame members, and adapted to be self-supporting on a generally horizontal surface, and having a front, top, rear, opposing sides and a bottom, said net and goal frame combination including:

a. substantially inelastic netting having an expanse large enough to cover the top, rear, and opposing sides of said frame, and having a perimeter portion that extends by a predetermined distance beyond the expanse of said net, and peripherally extending channel means in said perimeter portion;

b. an elastic cord joined end-to-end in a loop, and mounted slidably in said perimeter portion channel means whereby said net has an elastically constrictable opening; and c. whereby said net can be draped over, and positioned with respect to said frame, and held in place by said perimeter portion resiliently embracing said frame.

* * * * *